US006363912B1

(12) United States Patent
Flach

(10) Patent No.: US 6,363,912 B1
(45) Date of Patent: Apr. 2, 2002

(54) METHOD FOR REGULATING THE ENGINE SPEED IN MULTI-CYLINDER INTERNAL COMBUSTION ENGINES

(75) Inventor: Michael Flach, Kaltenkirchen (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/601,853

(22) PCT Filed: Feb. 8, 1999

(86) PCT No.: PCT/DE99/00335

§ 371 Date: Aug. 9, 2000

§ 102(e) Date: Aug. 9, 2000

(87) PCT Pub. No.: WO99/40308

PCT Pub. Date: Aug. 12, 1999

(30) Foreign Application Priority Data

Feb. 9, 1998 (DE) ..... 198 05 113

(51) Int. Cl.[7] ..... F02D 41/14

(52) U.S. Cl. ..... 123/436; 123/352; 701/105

(58) Field of Search ..... 123/339.16, 339.19, 123/350, 352, 357, 436, 480, 476, 478; 701/104, 105, 106, 110, 111; 73/116, 117.3

(56) References Cited

U.S. PATENT DOCUMENTS

| | | | | | |
|---|---|---|---|---|---|
| 4,134,374 A | * | 1/1979 | Latsch et al. | ..... | 123/436 |
| 4,575,800 A | * | 3/1986 | Kittelson | ..... | 701/105 |
| 5,222,022 A | * | 6/1993 | Adams et al. | ..... | 701/110 |
| 5,231,966 A | * | 8/1993 | Yoshida et al. | ..... | 123/436 |
| 5,268,842 A | * | 12/1993 | Marston et al. | ..... | 701/105 |
| 5,377,537 A | | 1/1995 | James | ..... | 73/117.3 |
| 5,878,711 A | * | 3/1999 | Kamura et al. | ..... | 123/339.16 |

FOREIGN PATENT DOCUMENTS

| | | | | |
|---|---|---|---|---|
| DE | 33 39 231 | | 5/1984 | |
| EP | 406765 A1 | * | 7/1990 | ..... 123/352 |
| EP | 0 403 212 | | 12/1990 | |
| EP | 0 481 983 | | 4/1992 | |
| EP | 0 695 865 | | 2/1996 | |
| WO | WO 91/00956 | | 1/1991 | |

* cited by examiner

*Primary Examiner*—Willis R. Wolfe
(74) *Attorney, Agent, or Firm*—Kenyon & Kenyon

(57) ABSTRACT

A method of regulating the rotational speed of multicylinder internal combustion engines is described using the rotational speed can be detected precisely and rapidly in a simple and cost-effective manner, permitting stable regulation to a constant rotational speed in the event of periodic and temporary rotational speed fluctuations. The time required for a fixed sequence of successively sensed pulses is continuously measured and used to form equidistant, uncorrected actual rotational speed values. The number of successively sensed pulses is defined as a function of the number of cylinders in the engine and the number of pulses that can be generated by the pole wheel per revolution. The time required for the number of sensed pulses corresponding to one complete revolution of the pole wheel is measured and used to form an average rotational speed. The difference between the average rotational speed and each uncorrected actual rotational speed value is smoothed to form corrected actual rotational speed values. Its magnitude is limited and it is added to the uncorrected actual rotational speed value. The corrected actual rotational speed values are compared with the predefined setpoint rotational speed value and fed to a controller, whose output variable is used to control the actuator.

15 Claims, 2 Drawing Sheets

METHOD FOR REGULATING THE ENGINE SPEED IN MULTI-CYLINDER INTERNAL COMBUSTION ENGINES

FIELD OF THE INVENTION

The present relates to a method of regulating the rotational speed of multicylinder internal combustion engines having a crankshaft and fuel injection, in particular slow-running marine diesel engines, at least one sensor is used to detect the speed and direction of rotation of a pole wheel, which is driven by the crankshaft and, for each revolution, generates pulses which can be sensed by the sensor, and deviations of the rotational speed from a predefined setpoint value are compensated for by an actuator which acts on the fuel injection of the engine.

BACKGROUND INFORMATION

Methods of this type are primarily used in diesel engines which, e.g., in comparison with spark-ignition engines, for example, inevitably require the idling speed to be regulated and the maximum rotational speed to be limited. The injection pumps used for this inject more or less fuel into the cylinders as a function of the existing rotational speed, for which purpose they are adjusted via appropriate control devices. In large diesel engines, e.g., in the case of large two-stroke engines which can often be found on board ships, each cylinder is provided with its own individual injection pump, which receives a hydraulic power boost because of the necessary, high actuating forces. The large two-stroke engines used on board ships because of their proven reliability, are generally designed as in-line engines having four to twelve cylinders, and operate in a nominal rotational speed range of 50 to 120 rev/min. Since marine diesel engines are reversible, that is to say, can run in both directions of rotation, the camshafts have cams for forward and reverse running, which operate the individual injection pumps.

Due to the low nominal rotational speeds, the result is minimum rotational speeds of 12 to 25 rev/min, which are characterized by rough running. The cause of this is rotational speed fluctuations, which are brought about by periodic interferences such as the individual ignition operations, and by temporary irregularities such as load surges, changes in the drive torque, ignition misfires or other malfunctions of the injection pumps. In order to avoid the engine stopping or overrunning, the rotational speed fluctuations are compensated for by readjusting to a constant rotational speed.

Methods for maintaining predefined setpoint rotational speed values are known which correct both static deviations, that is to say periodic rotational speed deviations at constant load, and dynamic deviations, that is to say, temporary setpoint value deviations, such as during start-up between idling and full load. Thus, European Patent No. 0 481 983 B1 describes a method of regulating the rotational speed of a slow-running multicylinder diesel engine in which, for each of the cylinders, angular positions of the crankshaft are defined which represent the starting angle and finishing angle of an angular range located before the top dead center of the cylinder. For these angular ranges, which are detected by means of a sensor for corresponding pulse-generating marks which rotate with the crankshaft, an actual value is measured continuously, which indicates the average speed at which the crankshaft passes through this angular range. This actual value,.is fed to a "rapid", that is to say, proportionally acting, controller, which acts on the charging level (volumetric efficiency) of the cylinder assigned to the corresponding angular range. In addition, a speed of the crankshaft averaged over a number of these angular ranges is measured and fed to a "sluggish", that is to say, an integrally or proportionally-integrally acting controller, which is used to preset the charging level of all the cylinders. In order to compensate for occurring disturbances as early as possible through correction of the charging level, the position of the angular ranges determined by the starting and finishing angles is also adjusted as a function of the rotational speed of the crankshaft.

It proves to be a drawback of this method, that the regulation of low rotational speeds of below approximately 25 $min^{-1}$ cannot be carried out satisfactorily. In addition, the dynamic rotational speed deviations occurring as a result of load surges cannot be compensated for better than with conventional rotational speed controllers. Furthermore, rough movements of the charging linkage can be observed under constant load if the injection pumps are not adjusted exactly. In the event of malfunctioning of individual injection pumps, large periodic movements of the charging linkage can be seen, which result from the fact that the "quick" controller is continuously attempting to correct the dip in the rotational speed of the respective cylinder caused by this.

SUMMARY

The present invention is based on the object of developing a method of regulating the rotational speed of multicylinder internal combustion engines to the effect that, whilst avoiding the above-described disadvantages, precise and rapid detection of, the rotational speed may be achieved in a simple and cost-effective manner, permitting stable regulation to a constant rotational speed in the event of periodic and temporary rotational speed fluctuations.

This object of the present invention is achieved by continuously measuring the time required for a fixed sequence of successively sensed pulses and using it to form equidistant, uncorrected actual rotational speed values, the number of successively sensed pulses being defined as a function of the number of cylinders in the engine and the number of pulses that can be generated by the pole wheel per revolution; by measuring the time required for the number of sensed pulses corresponding to one complete revolution of the pole wheel and using it to form an average rotational speed; by smoothing the difference between the average rotational speed and each uncorrected actual rotational speed value in order to form corrected actual rotational speed values, by limiting its magnitude and adding it to the uncorrected actual rotational speed value; and by comparing the corrected actual rotational speed values with a predefined setpoint rotational speed value and feeding them to a controller, whose output variable is used to control the actuator.

Using such a method, both temporary and periodically occurring rotational speed fluctuations are identified rapidly and precisely, and compensated for by the controller through appropriate control of the actuator acting on the fuel injection.

It is of particular advantage to define the number of successively sensed pulses as the rounded quotient of the number of pulses that can be generated by the pole wheel per revolution, and the number of cylinders in the engine. This offers the advantage that a sequence of sensed pulses can be assigned to a cylinder, with the consequence that the actual rotational speed value formed corresponds to the averaged rotational speed of the crankshaft over a rotational angular range, in which two cylinders firing one after another assume the same position, e.g. top dead center. In this manner, the actual determined rotational speed value contains no influences occurring periodically during one working cycle, such as the ignition processes.

According to an advantageous further refinement of the present, the uncorrected actual rotational speed values are formed at intervals of two successive pulses. This means that, in the event of a number of more than two pulses of a set pulse sequence, the uncorrected actual rotational speed values formed are assigned to overlapping angular ranges of the crankshaft, so that the rotational speed can be detected precisely and rapidly because of the resulting high number of actual rotational speed values.

According to an additional feature of the present invention, each sequence of sensed pulses is assigned a measured value store, in which the time intervals of the successively sensed pulses are summed to form an uncorrected actual rotational speed value. This permits each sensed pulse to be assigned simultaneously, and in a simple manner, to a number of pulse sequences resulting from the corresponding actual rotational speed values, on account of the overlapping angular ranges of the crankshaft. This can be implemented in a conventional manner using a process computer having a nonvolatile memory. Expediently, following the formation of an uncorrected actual rotational speed value, the content of the measured value store is kept, at least for one revolution, before being deleted and assigned to a new sequence of sensed pulses. As a result, the measured value can be used for calculating the averaged rotational speed value. In addition, further evaluations of the rotational speed variation (characteristic curve), such as with regard to detecting misfiring or acceleration occurrences, are then possible.

The pulses are advantageously sensed using two sensors arranged to be offset by 90°, in order to detect the direction of rotation of the crankshaft, which can be reversed particularly in marine diesel engines, and as a result, to establish the sign when counting the pulses. It is also advantageous to use as the pole wheel, a gearwheel having teeth arranged in a uniformly distributed manner along its circumference, so that the sensing of pulses is ensured in a simple manner. According to a further advantageous feature of the present invention, a pulse is generated in the direction of rotation by both the leading and trailing flanks of a rotating gearwheel, in order to obtain a high number of pulses which can be sensed. A particularly advantageous implementation of the method to this end results in the case of approximately symmetrical tooth flanks, so that constant time intervals between the individual measurements can be achieved. The measurement accuracy is not influenced by the arrangement of the teeth or sensors.

Advantageously, the pulses are sensed equidistantly, so that digital sampling control can be used and a mark-to-space ratio of approximately 1 results. For this purpose, it is also advantageously proposed to use a gearwheel having a ratio of tooth thickness to gap width on the pitch circle of approximately 1.

According to a feature of the present invention, the pulses are detected by means of inductive, capacitive or optical position sensors in order to achieve a simple and cost-effective measurement set-up. Alternatively, use can also be made of incremental position sensors driven without slip or no other digital or analog detector circuits coupled to the crankshaft.

In order to regulate to constant rotational speeds in a stable manner, a development of the invention uses a proportional-integral controller with a derivative action time, which corrects the occurring rotational speed deviations. Finally, it is proposed to use adaptive control in order, for example, to take into account influences arising from the environment.

DETAILED DESCRIPTION

Figure 1:
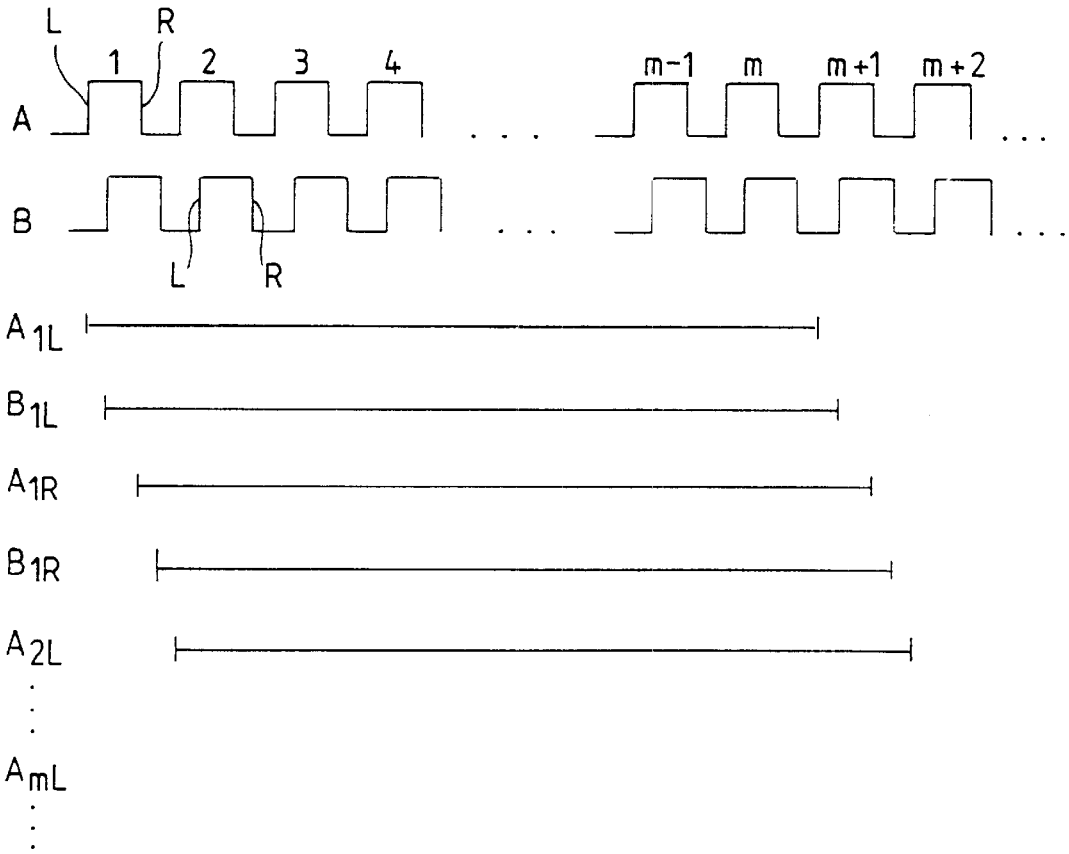
FIG. 1 shows pulses picked up using two sensors, and the time required for a defined pulse sequence.

In the upper part of FIG. 1, the sensed signals from two sensors A and B can be seen. The sensors A and B are arranged to be offset by an angle of 90°, which results in a displacement of the square-wave signal sequence from the sensor B with respect to the sensor A. In order to evaluate the square-wave signals, both the rising flank L and the falling flank R are used.

The lower part of FIG. 1 illustrates the time required for a defined sequence of successively sensed pulses. The number of successively sensed pulses corresponds to m and results from the quotient of the number of pulses that can be generated by a pole wheel per revolution and the number of cylinders in an engine. If the number of teeth is not divisible by the number of cylinders, the rounded quotient is used. The residual ripple caused by this is compensated for by corrective regulation in accordance with FIG. 2. If a gearwheel having 60 teeth is used as the pulse-generating pole wheel, m accordingly assumes the value 10 in a 6 cylinder, two-stroke engine. This means that 10 successive pulses form a pulse sequence, and the time they require is used to ascertain an uncorrected actual rotational speed value, as illustrated by the lines shown in the lower part of FIG. 1.

Figure 2:
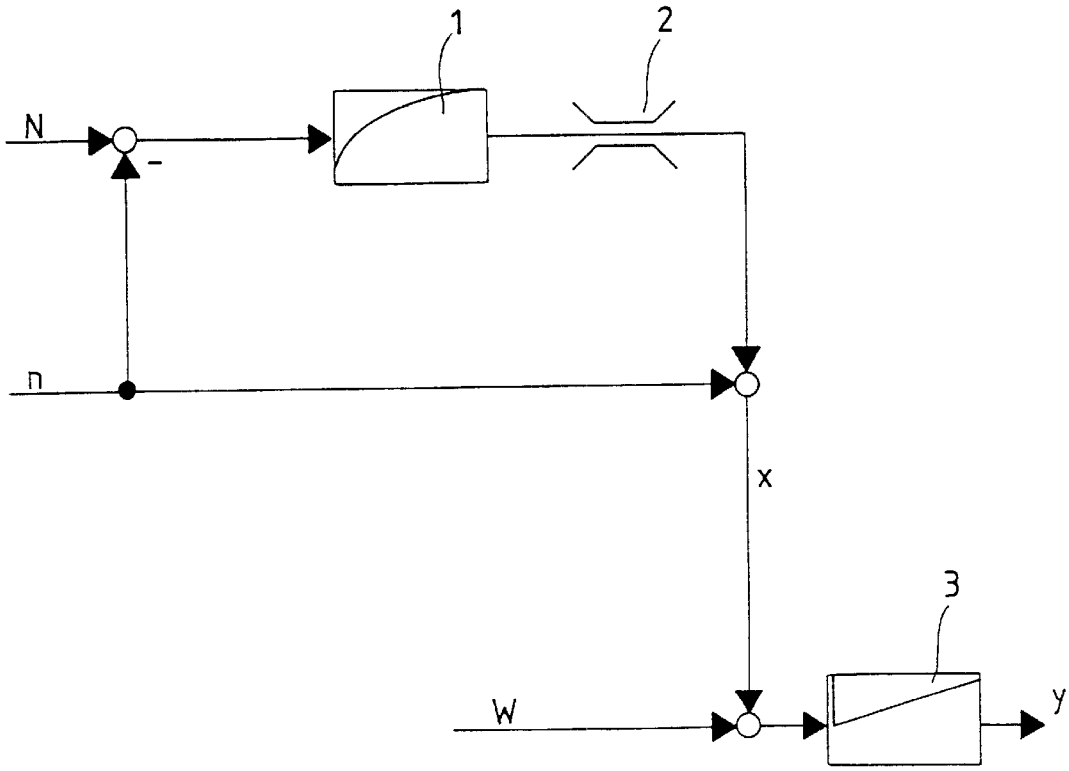
FIG. 2 shows a signal flow diagram for rotational speed regulation.

The signal flow diagram depicted in FIG. 2 contains an element 1, which carries out time-constant smoothing of the difference between a rotational speed N averaged over a complete revolution of a crankshaft and an uncorrected actual rotational speed value n averaged over an angular range of the crankshaft established by the pulse sequence. The smoothing function used here can be the reciprocal value of the rotational speed N averaged over a complete revolution of the crankshaft. The magnitude of the result formed in this manner is limited by an element 2 and, in order to form a corrected actual rotational speed value x, is added to the uncorrected actual rotational speed value n. The corrected actual rotational speed value x is then compared with a predefined setpoint rotational speed value w and fed to an element 3 which is designed as a PID controller. The output variable y from the PID controller 3 is used to control an actuator which, in the present case, is a charging linkage, which belongs to an injection pump and influences the charging level of an engine cylinder.

The functioning of the rotational speed detection system shown in FIG. 1, and the control system shown in FIG. 2, is illustratively explained below using a 6-cylinder, two-stroke diesel engine. The individual cylinders of the diesel engine are supplied during the compression phase with fuel by means of individual injection pumps, the quantity of said fuel being determined by the charging level in proportion to the combustion air. The charging level is varied by the control rod of the injection pump, which is controlled by the output variable y from the PID controller. In order to synchronize the firing times of the individual cylinders, the rotational angle of the crankshaft is detected by means of position sensors. For this purpose, use is made of two inductive proximity switches, which are arranged to be offset by 90° and which sense the pulses generated by a gearwheel rotating with the crankshaft. In this manner, the speed and direction of rotation of the crankshaft can be ascertained simultaneously without requiring any complicated, attached parts on the diesel engine. The gearwheel, which has 60 teeth spaced apart uniformly and equally from one another, is connected directly to the crankshaft, so that the measured rotational speed of the gearwheel is the same as the rotational speed of the crankshaft. The two inductive proximity sensors detect both the leading and trailing flanks of the gearwheel teeth in the direction of rotation, so that a total of 240 pulses are sensed per complete revolution of the gearwheel, which ensure precise and rapid detection of the rotational speed. Because the gearwheel has 60 teeth and the engine has six cylinders, ten pulses constitute a pulse sequence for forming the uncorrected actual rotational speed value n.

The pulse sequences are counted in intervals of successive pulses, so that in the case of two sensors, 60 teeth and six cylinders, 240 actual rotational speed values n and 240 averaged rotational speed values N are ascertained per revolution. For each actual rotational speed value n, there is a measured value store, in which the time intervals of the associated pulses are summed. The content of each measured value store is stored for one revolution, so that each pulse is assigned a measured value store. Therefore, 240 measured-value storage locations are needed for the present case. Because of the uniform and equally-spaced arrangement of the teeth on the gearwheel, the ratio between pulse and interpulse period is approximately 1. However, the ratio of pulse and interpulse period, and also the distance between the two sensors A and B and any asymmetries in the ascertained square-wave-signal sequences, which may be based on production inaccuracies in the gearwheel, do not influence the measurement result. This can be attributed to the fact that measurement inaccuracies, periodic errors in the actual rotational speed value n or residual ripple, which would result if the number of cylinders could not be divided by the number of teeth, are eliminated through correction using elements 1 and 2. In this manner, poorly adjusted, worn or even failed injection pumps affect the actual rotational speed value n only at the instant of the change. As long as the error is not greater than that predefined by the element 2, it is corrected after a period of time corresponding to three times the smoothing time of element 1 has elapsed.

Using the above-described method, rapid and accurate detection of the rotational speed can be implemented in a simple manner. Furthermore, the rotational speed of the diesel engine is kept constant with high accuracy, even when there are rapid load changes, such as occur, e.g., in marine diesel engines when the ship's propeller surfaces from the water in rough seas. Last but not least, the result is a stable control response under constant load, which prevents irregular movement of the injection pump's control rod.

What is claimed is:

1. A method of regulating rotational speed of a multicylinder internal combustion engine having a crankshaft and fuel injection, comprising:

detecting, using at least one sensor, a rotational speed and direction of rotation of a pole wheel which is driven by the crankshaft and generates, for each revolution, pulses sensed by the at least one sensor;

compensating for deviations of the rotational speed from a predefined setpoint rotational speed value using an actuator which influences the fuel injection of the engine;

continuously measuring a time required for a defined sequence of successively sensed pulses, the number of successively sensed pulses being defined as a function of a number of cylinders of the engine and a number of pulses generated by the pole wheel per revolution;

determining equidistant, uncorrected actual rotational speed values using the continuously measured time;

measuring a time required for the number of sensed pulses corresponding to one complete revolution of the pole wheel to form an average rotational speed;

smoothing a difference between the average rotation speed and each uncorrected actual rotation speed value to form corrected actual rotational speed values;

limiting a magnitude of the smoothed difference;

adding the limited smoothed difference to the uncorrected actual rotation speed values;

comparing the corrected actual rotational speed values with the predefined setpoint rotational speed value;

feeding a result of the comparison to a controller; and determining an output value using the result to control the actuator.

2. The method according to claim 1, wherein the engine is a slow-running marine diesel engine.

3. The method according to claim 1, wherein the number of successively sensed pulses is defined as a rounded quotient of the number of pulses generated by the pole wheel per revolution and the number of cylinders of the engine.

4. The method according to claim 1, wherein the uncorrected actual rotational speed values are formed in intervals of two successive pulses.

5. The method according to claim 1, wherein each sequence of sensed pulses is assigned a measured value store, in which time intervals of the successively sensed pulses are summed to form one of the uncorrected actual rotational speed values.

6. The method according to claim 5, wherein after forming the one of the uncorrected actual rotational speed values, contents of the measured value store are kept for at least one revolution before being deleted and assigned to a new sequence of sensed pulses.

7. The method according to claim 1, wherein the at least one sensor includes two sensors arranged at a 90° offset with respect to each other.

8. The method according to claim 1, wherein a gearwheel having teeth distributed uniformly along a circumference is used as the pole wheel.

9. The method according to claim 8, wherein a pulse is generated by both leading and trailing flanks of the teeth of the gearwheel in a direction of rotation.

10. The method according to claim 9, wherein the flanks are symmetrical.

11. The method according to claim 1, wherein the pulses are sensed equidistantly.

12. The method according to claim 8, wherein the gearwheel has a ratio of tooth thickness to gap width of a pitch circle of 1.

13. The method according to claim 1, wherein the at least one sensor includes one of an inductive, capacitive and optical position sensor.

14. The method according to claim 1, wherein the controller is a proportional-integral controller with a derivative action time.

15. The method according to claim 1, further comprising: using adaptive control to control the actuator.

* * * * *